United States Patent [19]

Hughes et al.

[11] 4,292,736

[45] Oct. 6, 1981

[54] METHOD FOR MAKING JACK TYPE RECEPTACLES

[75] Inventors: Donald W. K. Hughes, Mechanicsburg; Ronald W. Myers, Landisburg, both of Pa.

[73] Assignee: AMP Incorporated, Harrisburg, Pa.

[21] Appl. No.: 100,669

[22] Filed: Dec. 5, 1979

Related U.S. Application Data

[63] Continuation-in-part of Ser. No. 940,536, Sep. 8, 1978, Pat. No. 4,221,458.

[51] Int. Cl.[3] ..... H01R 43/00

[52] U.S. Cl. ..... 29/884; 29/876

[58] Field of Search ..... 29/884, 876, 874; 339/126 R, 171 LC; 264/275, 277

[56] References Cited

U.S. PATENT DOCUMENTS.

| | | | |
|---|---|---|---|
| 3,399,377 | 8/1968 | Warzecka . | |
| 3,431,545 | 3/1969 | Kirby . | |
| 3,846,896 | 11/1974 | Bakermans et al. . | |
| 3,850,497 | 11/1974 | Krumreich et al. . | |
| 4,071,696 | 1/1978 | Anderson . | |
| 4,153,327 | 5/1979 | Johnson . | |
| 4,193,654 | 3/1980 | Hughes et al. | 339/17 LC |
| 4,210,376 | 7/1980 | Hughes et al. | 339/17 LC |
| 4,221,458 | 9/1980 | Hughes et al. | 339/126 R |
| 4,225,209 | 9/1980 | Hughes | 339/126 R |
| 4,231,628 | 11/1980 | Hughes et al. | 29/884 X |

*Primary Examiner*—Nicholas P. Godici
*Assistant Examiner*—C. J. Arbes
*Attorney, Agent, or Firm*—Frederick W. Raring

[57] ABSTRACT

A method of manufacturing a connector receptacle of the telephone jack type is disclosed. The jack housing is produced as a one-piece molding having conductor-receiving channels extending across one of its external sidewalls from the plug-receiving end to the rearward end. The conductors are manufactured by stamping a flat strip to produce groups of spaced-apart conductors extending laterally of the length of the strip. To assemble the conductors to the housing, a group of conductors is positioned in alignment with the channels and the conductors are inserted into the channels. First end portions of the conductors are reversely bent so that they extend diagonally into the plug-receiving opening of the housing and second end portions may be bent laterally and offset from each other so that the second ends can be inserted into staggered holes on a circuit board.

11 Claims, 17 Drawing Figures

METHOD FOR MAKING JACK TYPE RECEPTACLES

FIELD OF THE INVENTION

This invention relates to the manufacture of multi-contact electrical connector receptacles, particularly of the telephone jack type.

BACKGROUND OF THE INVENTION

A widely used type of electrical connector receptacle is described in general terms in a Report and Order of the Federal Communications Commission, which was published in the *Federal Register* of July 12, 1976, pages 28694–28735. This type of receptacle, which is commonly referred to as a "jack", is widely used in the telephone industry and is being used to an increasing extent in related fields, such as on equipment used with the telephone system and other consumer products which require relatively small electrical connectors. The Federal Communications Commission Report in the *Federal Register* defines, in general terms, dimensions and features of standard jacks so that such jacks can be produced by different manufacturers to standards which will ensure interchangeability among the jacks of all of the manufacturers. The FCC Report, however, does not specify details of the standard jacks so that manufacturers of such jacks are free to innovate and to introduce their own improvements to this type of product.

Most of the receptacle jacks which have been produced in the past use drawn wire which has been gold plated for the conductors which are contained in the jack, these conductors comprising a contact spring portion which extends into a plug-receiving opening in the jack and a lead portion which extends through one of the housing walls of the jack. The lead portion is commonly connected by a crimped ferrule to a stranded wire, which in turn, extends to external circuitry.

Application Ser. No. 940,536 filed Sept. 8, 1978, now U.S. Pat. No. 4,221,458, discloses and claims a connector jack comprising a relatively easily manufactured one-piece molded housing and sheet metal stamped conductors which are mounted in channels on one of the external surfaces of the housing and which extend into the plug-receiving end thereof. The conductors have end portions which extend laterally from the housing so that the jack can be mounted on a circuit board and the conductors soldered directly to the circuit board conductors. Connector jacks having stamped and formed conductors are receiving a favorable reception in the electronics industry and several different specific types of such connector jacks have been proposed to satisfy the needs of the industry as regards the position in which the jack is mounted on a circuit board and the circumstances under which the jack is used. Application Ser. No. 014,442 filed Feb. 23, 1979 now U.S. Pat. No. 4,210,376, discloses an improved connector jack having a housing which provides a high degree of protection for the conductors and which has a continuous frame surrounding the plug-receiving opening of the housing. Application Ser. No. 040,242 filed May 18, 1979 now U.S. Pat. No. 4,225,209, shows another type of jack, having stamped conductors, which is adapted to be mounted on a circuit board with one of the end-walls of the jack housing against the surface of the circuit board.

The present invention is directed to the achievement of improved manufacturing methods for producing telephone jacks having stamped and formed conductors assembled to the jack housing as disclosed, for example, in the above identified pending applications. In accordance with the method of the present invention, the housing is produced as a one-piece molding and the conductors are manufactured by stamping a strip of sheet metal so that the stamped strip has, at spaced intervals, groups of conductors extending therefrom, the number of conductors in each group being equal to the number required for a single connector. The strip is preferably gold plated along a relatively narrow band which ultimately becomes the contact surface of each conductor and the conductors are then assembled to a housing by aligning a group of conductors with spaced-apart channels in one of the sidewalls of the housing and moving the conductors into these channels. First end portions of the conductors are bent into the plug-receiving opening and the second end portions are bent, with respect to the housing, such that they extend laterally beyond one of the external walls of the housing. The connector can then be connected to conductors on a circuit board by simply inserting the second end portions of the conductors into holes in the circuit board and soldering the conductor ends to the circuit board conductors.

DRAWINGS

Figure 13:
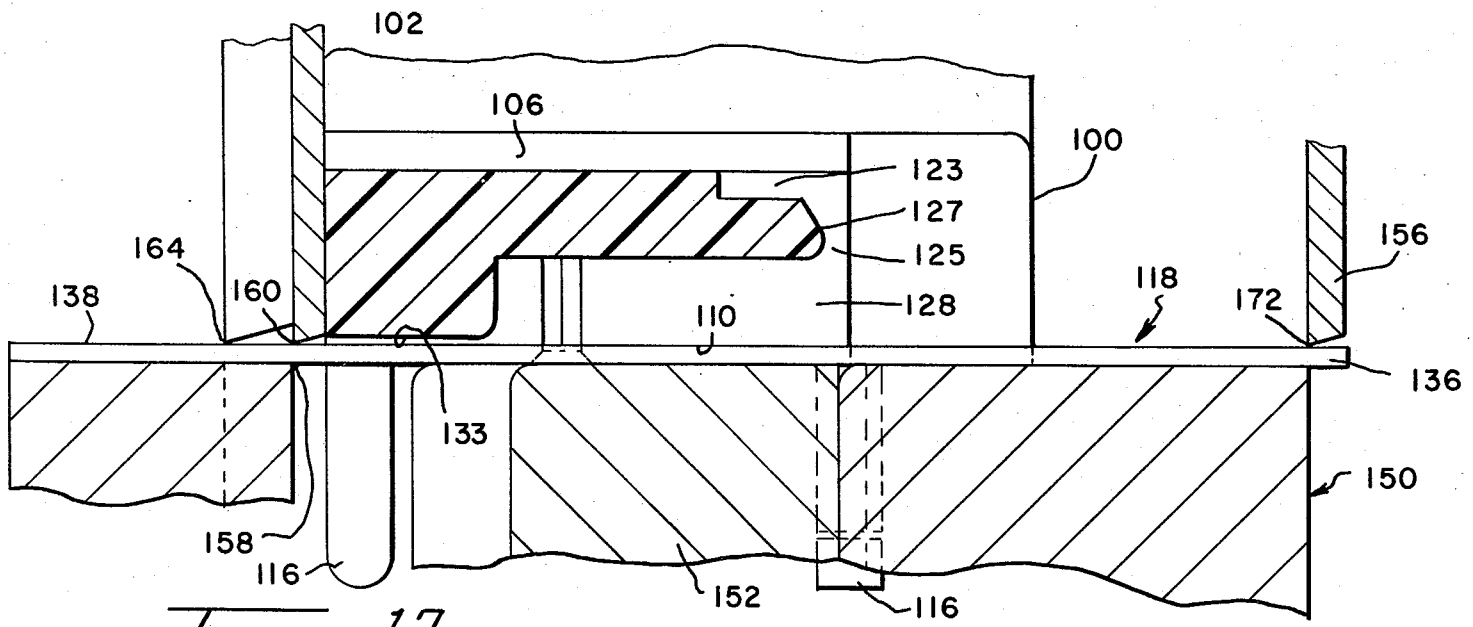
FIG. 13 is a fragmentary cross-sectional view of the lower portion of a receptacle housing and showing the conductor assembly tooling for assembling conductors to the housing, this view showing the positions of the parts at the beginning of the assembly operation.
Figure 14:
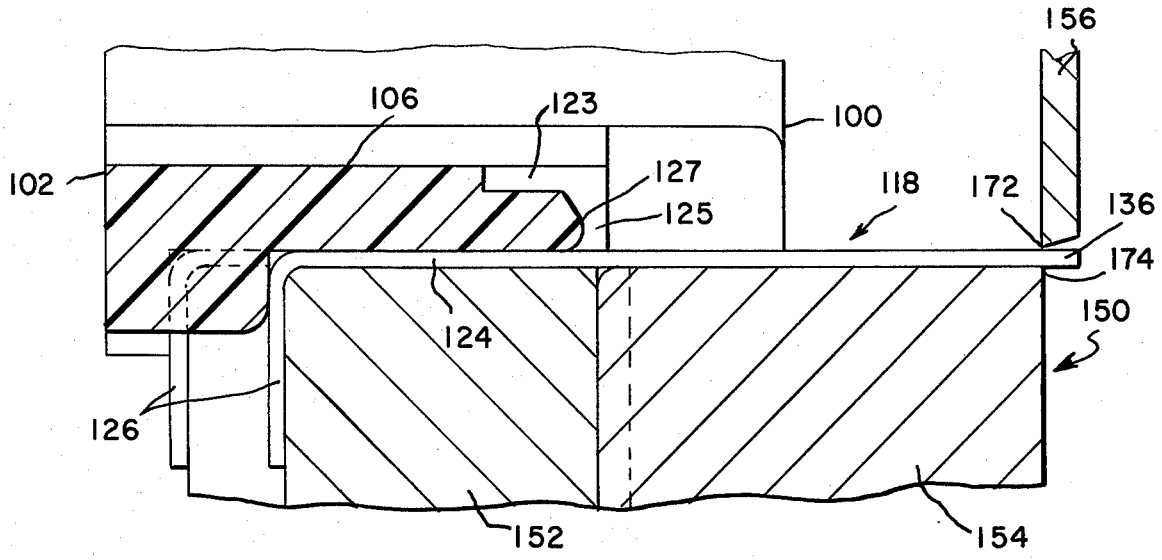
Figure 15:
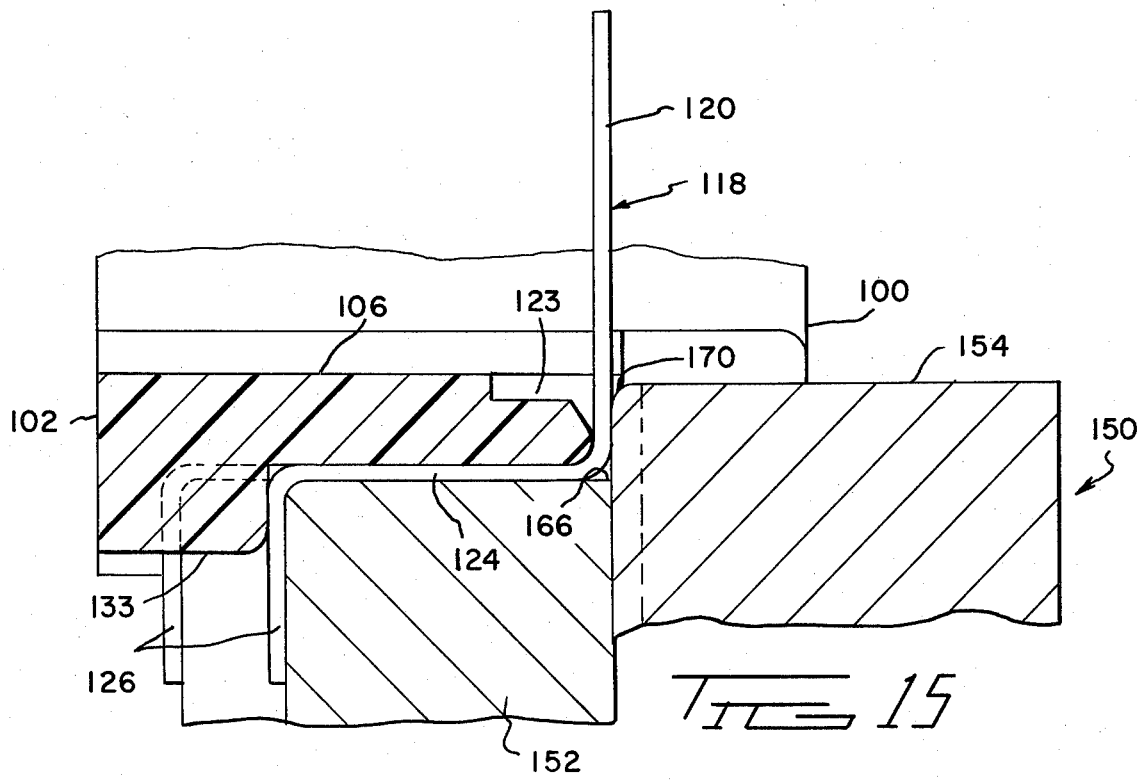

FIGS. 14 and 15 have views similar to FIG. 13, illustrating successive stages of the assembly operation.

Figure 16:
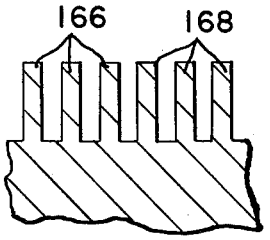

FIG. 16 is a cross-sectional view of a portion of the conductor assembly tooling.

Figure 17:
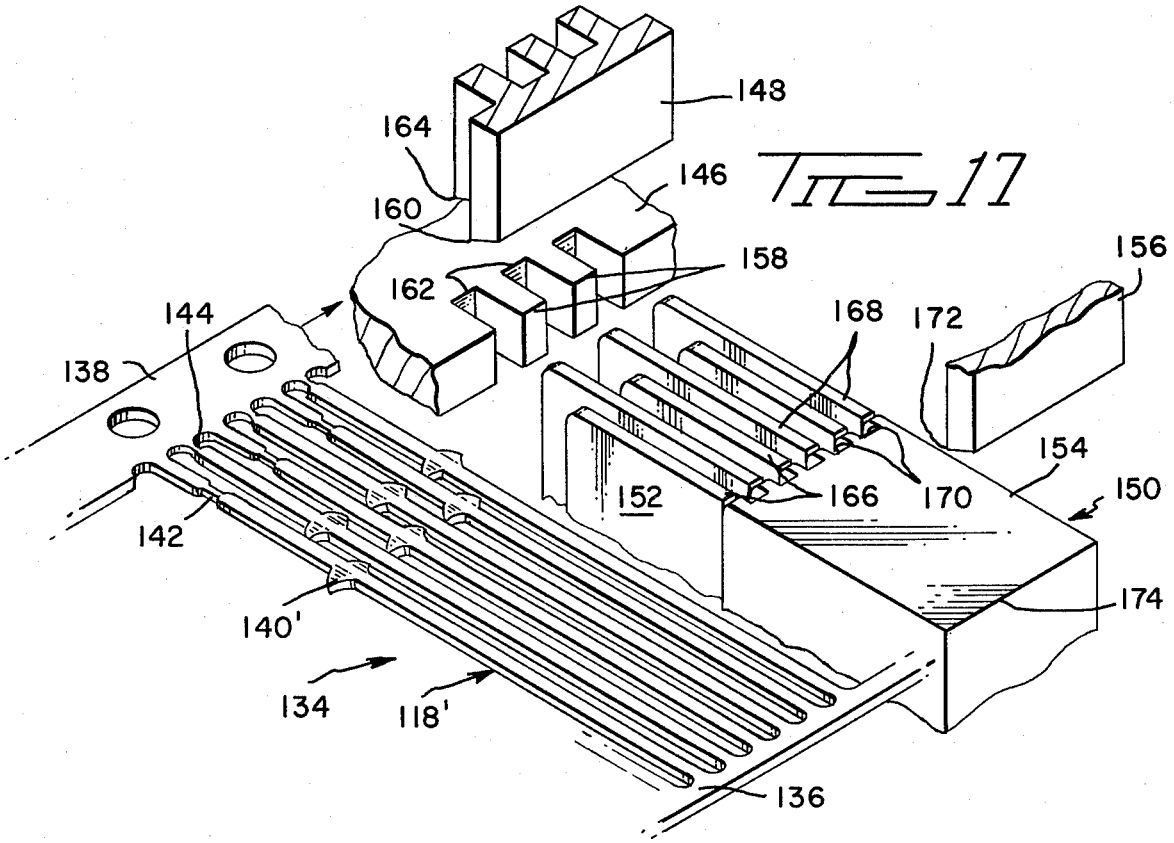

FIG. 17 is a perspective view showing the essential portions of the conductor assembly tooling and showing a portion of a strip of stamped conductors prior to assembly of the conductors to the receptacle housing.

DESCRIPTION OF THE DISCLOSED EMBODIMENTS

Figure 1:
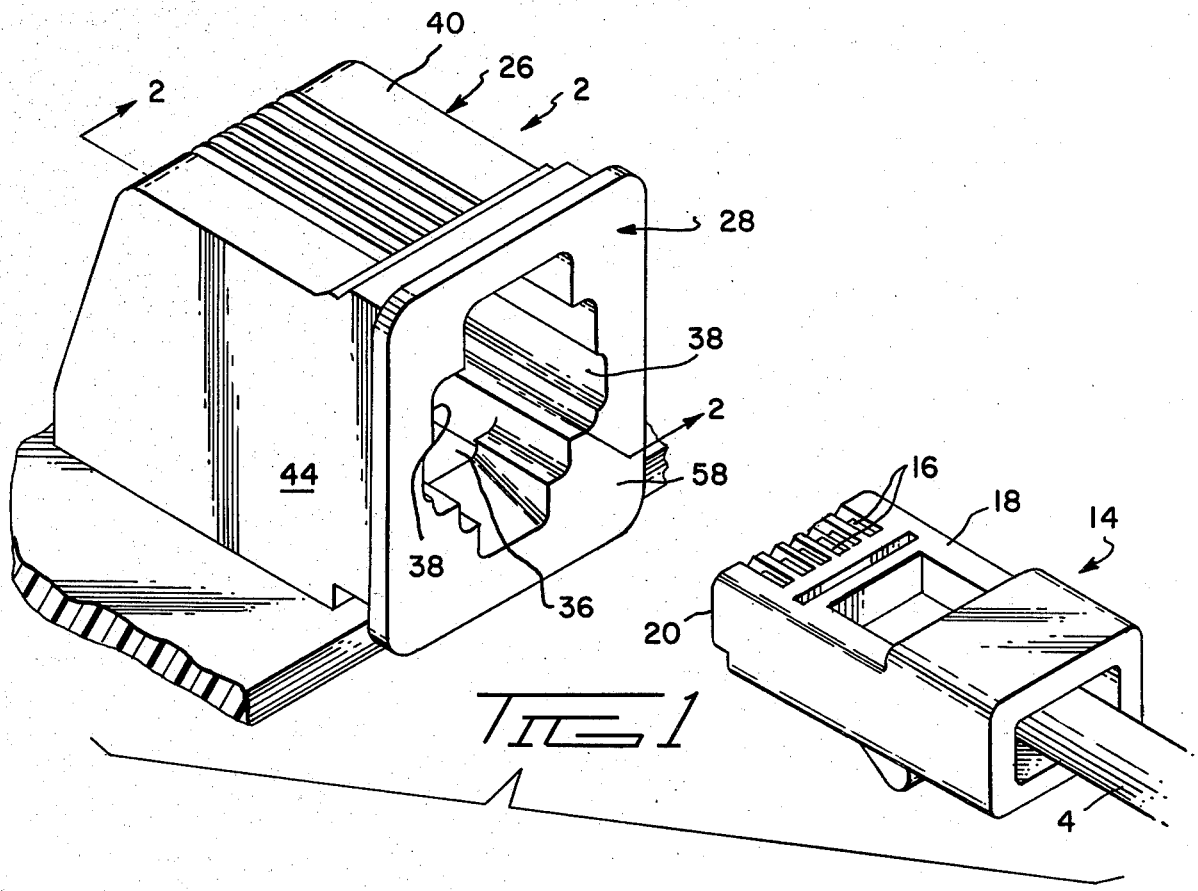
FIG. 1 is a perspective view of an electrical jack receptacle showing a connector plug in alignment with the plug-receiving opening of the jack housing.

FIG. 1 shows a jack receptacle 2 of a type which is coming into common usage in the electrical industry and FIGS. 6–9 illustrate the steps which are followed in the manufacture of the jack 2 of FIG. 1. The structural details of the jack are described briefly below and this description is followed by a detailed description of the manner of producing the jack receptacle.

The jack receptacle 2 serves to connect individual conductors in a cable 4 to conductors 6 on the underside 8 of a circuit board 10 having an upper surface 12 on which the receptacle is mounted. The cable 4 has connector plug 14 on its end and the conductors in the cable are in electrical contact with blade-like terminals contained in the plug and which extend to the upper surface 18 of the plug, as shown at 16. The upper edges of these blade-like terminals 16 engage conductors 62 in the jack receptacle when the plug is inserted into the receptacle. The latching arm 22 extends rearwardly from the lower surface of the plug and has rearwardly facing shoulders 24 which cooperate with shoulders 50 in the housing to latch the plug in its inserted position.

The connector 2 comprises a one-piece molded housing of nylon or other thermoplastic material having a plug-receiving end 28, a rearward end 30, and a plug-receiving opening 32 which extends inwardly from the plug-receiving end. Opening 32 has opposed first and second internal sidewalls 34, 36 and opposed internal endwalls 38. The housing has oppositely directed first and second external sidewalls 40, 42 and oppositely directed endwalls 44. Mounting posts 46 extend downwardly from the lower external sidewall 42 and are received within openings in the circuit board.

An upwardly inclined ramp 48 is provided in the plug-receiving opening and extends to the internal sidewall 36, this ramp providing clearance for the leading end of the latch arm and the shoulders 50 extend from the endwalls 38 at the end of this ramp on each side thereof, these shoulders being cooperable with the shoulders 24 to retain the plug in the housing. A backwall 52 extends partially downwardly from the internal sidewall 34, adjacent to the rearward end, and parallel barrier walls 56 extend forwardly from this backwall. The ends 65 of the conductors 62 are captured between adjacent barrier walls thereby to prevent shorting between adjacent conductors. The backwall 52 is located between sloping rearward portions 54 of the rearward end of the housing so that a recess 53 is provided at the rearward end of the housing.

The plug-receiving opening 32 is surrounded by a continuous frame 58 and a flange 60 extends from the edges of this frame to facilitate mounting of the connector in a panel opening.

A plurality of side-by-side conductors 62 are mounted on the housing, each conductor having a contact spring portion 64 which extends from the internal sidewall 34 adjacent to the plug-receiving end into the opening and diagonally towards the rearward end of the housing. Each conductor further has an intermediate portion 66 which extends across the external sidewall 40 and downwardly over the rearward end of the housing. Each conductor has a second end 67 and these ends 67 of the conductors extend through holes in the circuit board and are soldered, as shown, to the circuit board conductors 6. Each conductor extends through an aperture 68 in external sidewall 40 which communicates with the plug-receiving opening 32 and each conductor is reversely bent, as shown at 70, at the aperture. The conductors are thus physically separated from each other by the walls between adjacent apertures 68.

The intermediate portions of the conductors are disposed in spaced-apart side-by-side channels 72 in the external sidewall 40 and the conductors extend across the rearward end 30 of the housing and are received in channels 76, 74 in the lower portion of the rearward end. The channels 74 are relatively shallow, while the channels 76 are relatively deep, so that alternate conductors extend across and are disposed against the backwall 52 and the remaining conductors extend obliquely through the recess 53 and then extend downwardly through the shallow channels 74. The conductors are retained in the channels by barbs 78 which are received in recesses 80 in the sides of the channels.

Connectors of the type shown at 2 are produced by manufacturing the housing 2 as a one-piece molding having the spaced-apart apertures 68 thereon, the channels 72 in the sidewall 40, and the alternate deep and shallow channels 74, 76 in the lower portion of the backwall. As previously mentioned, the backwall extends only partially downwardly towards the internal sidewall 36 so that an opening extends through the rearward end of the housing to the plug-receiving opening 32. This opening permits molding of the rearwardly facing shoulders 50 in that the core pin can be positioned in the mold cavity to form these shoulders when the housing is molded and the core pin can subsequently be withdrawn.

Figure 5:
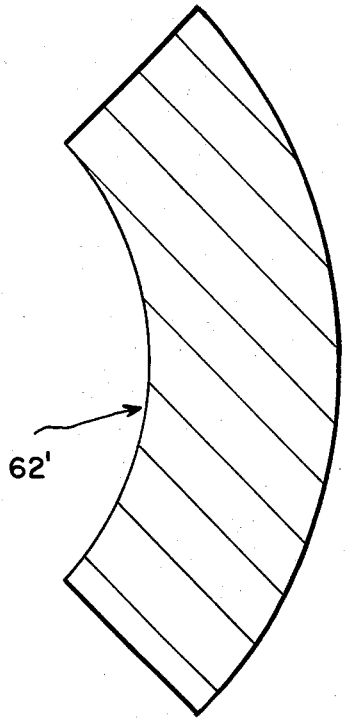
FIG. 5 is a cross-sectional view of one of the conductors of the strip.
Figure 3:
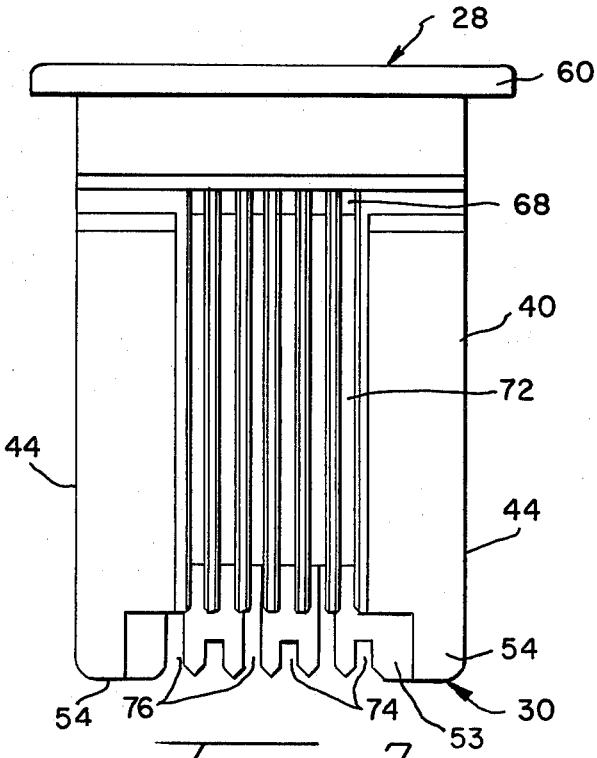
FIG. 3 is a top plan view of the jack housing.
Figure 4:
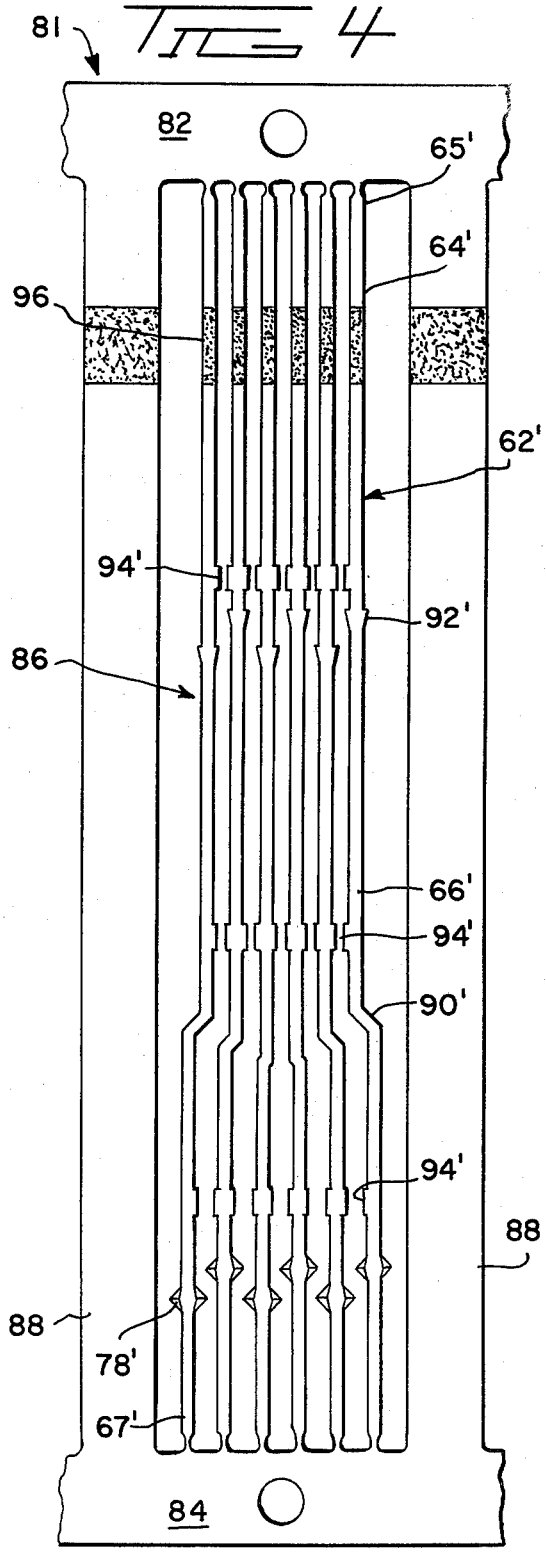
FIG. 4 is a plan view of a section of conductor strip used to produce jack receptacles in accordance with the invention.

The conductors are produced as a continuous strip 81, FIG. 4, by stamping a strip of conductive metal in a manner to provide parallel first and second carrier strips 82, 84, having groups 86 of conductor blanks extending between the carrier strips. Each group 86 has a number of conductor blanks equal to the number required for the housing with the ends 67′ of the blanks integral with carrier strip 84, and the ends 65′ integral with carrier strip 82. Each group of blanks is separated from the next adjacent group in the strip 81 by a transversely extending support strip 88 which is left in the strip to prevent damage to the conductor blanks. The blanks 62′ may be formed arcuately, as shown in FIG. 5, for improved contact with the terminals of the plug and to facilitate assembly of the conductor blanks to the housing. The portions 64′ of the blanks extend parallel to each other from the carrier strip 82, however, the portions 66′ diverge from an axis extending between the center conductor blanks so that the ends 67′ of the blanks are spaced-apart by distances greater than the spacing between the ends 64′. It will be understood that the ends 65′ of the conductors in the assembled jack receptacle are relatively closely spaced and the spacing between the conductors is increased by the diverging sections 90′ to facilitate mounting of the connector on a circuit board.

Relatively large barbs 78′ and smaller barbs 92′ may be provided to assist in retaining the conductors on the housing. It will be noted also that the conductor blanks 62′ have laterally extending enlarged portions, as shown at 94′ at three locations along the lengths of the blanks. These enlarged portions on each blank are the remnants of support strips which originally extended parallel to the carrier strips 82, 84. In stamping the blanks shown in FIG. 4, it is desirable to use three punches to form each opening between adjacent conductor blanks, rather than a single punch, for the reason that a single punch would be susceptible to damage during the stamping operation. After three such openings are thus formed by the three punches, the connecting necks which extend between adjacent blanks, are then removed in a separate punching operation and the remnants 94′ remain. The enlarged sections 94′ are shown in exaggerated width in FIG. 4, in the interest of clarity and in actual practice, these remnants of connector strips will be barely visible.

It is desirable to have gold contact surfaces on receptacle jacks, however, gold is required only on a portion of the contact spring section 64 of each conductor which engages the blade-type terminals 16 of the plug. The strip 81 can thus be selectively plated, as shown at 96, with a stripe of gold extending adjacent to the carrier strip 82. This selective plating of this strip results in a very substantial saving in the amount of gold required for an individual receptacle jack and thereby reduces the production cost.

Figure 2:
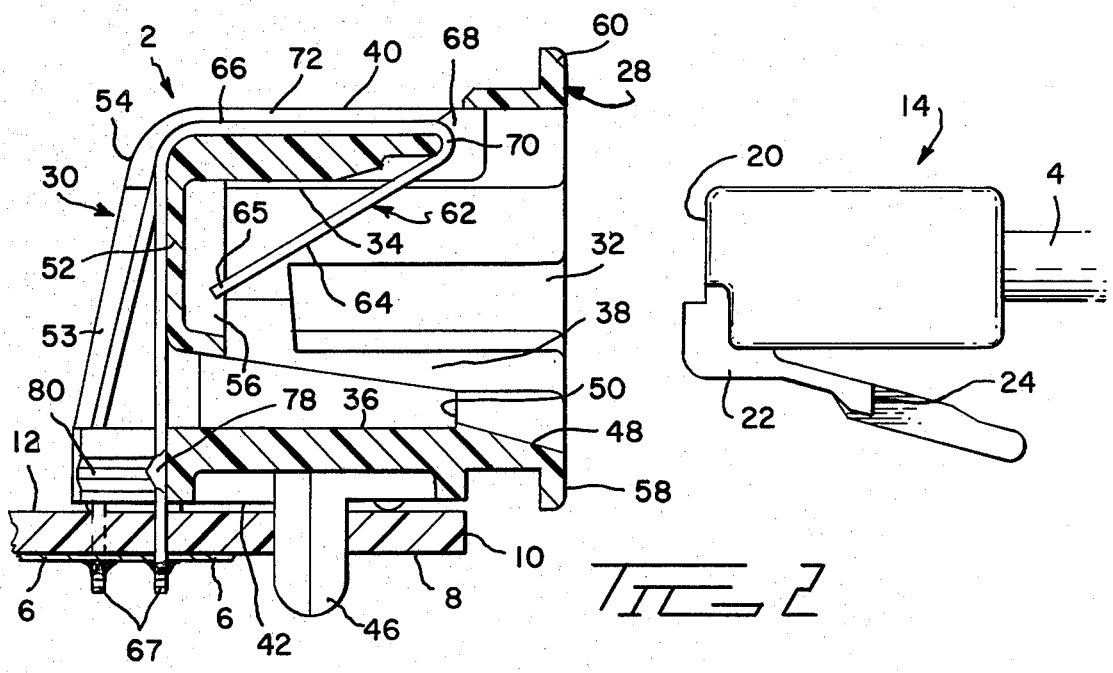
FIG. 2 is a cross-sectional view taken along the lines 2—2 of FIG. 1.
Figure 8:
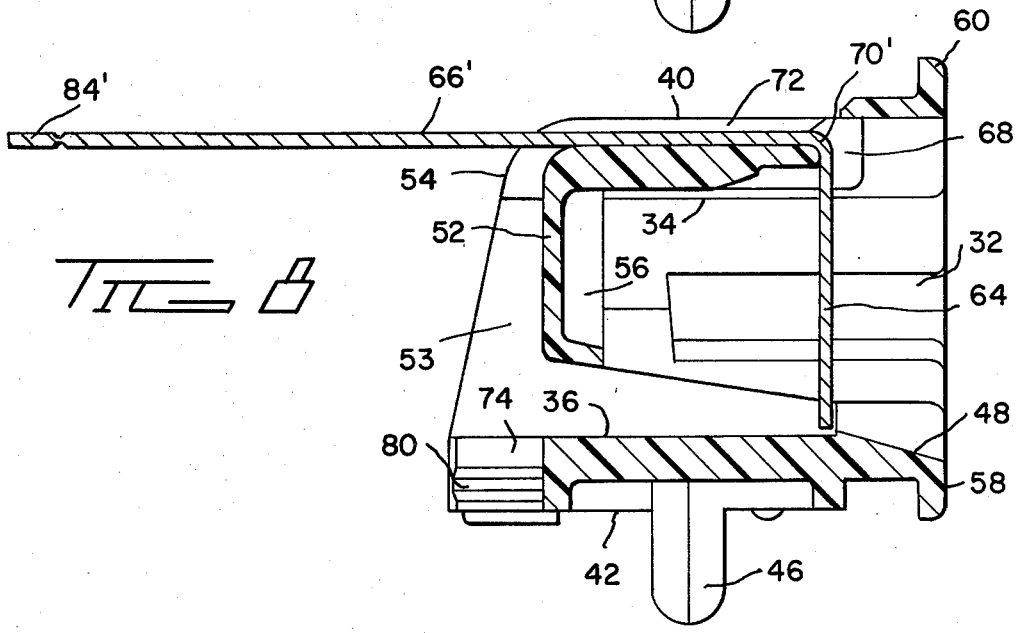
Figure 9:
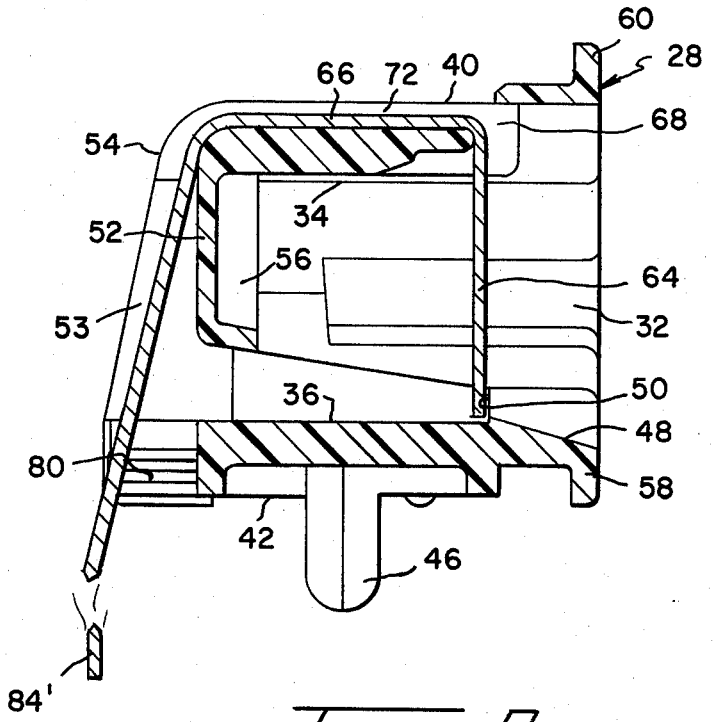

Referring now to FIGS. 6–9, a group 86 of conductors are assembled to a housing 26 by first removing the group of conductors from the continuous strip 81 then severing the carrier strip 82' from the group of conductors 64'. The contact portions of the conductor blanks are then bent at 70' so that they extend normally of the lead portions 66. The conductors are then aligned with the openings 68 in the housing and the entire group of conductors are moved downwardly, as shown in FIG. 8, until the lead portions are received in the channels 72. The lead portions will then extend leftwardly, as viewed in FIG. 8, beyond the rear end of the housing. The lead portions are then bent downwardly, as shown in FIG. 9, until they enter the shallow and deep channels 74, 76 in the lower portion of the rearward end of the housing. When the conductors are moved into the shallow channels, the remaining carrier strip 84' is severed from the group of conductors and alternate conductors are moved to the inner ends of the deep channels 76. Thereafter, the contact spring portions are bent inwardly so that they extend diagonally into the plug-receiving opening as shown in FIG. 2. Alternatively, these contact spring portions can be bent inwardly of the plug-receiving opening immediately after insertion of the lead portions into the channels 72. That is, this contact spring portion can be bent inwardly when the parts are as shown in FIG. 8 and prior to downward bending of the intermediate portions over the rearward end of the housing. The barbs 78' of the blanks are wedged in recesses 80 in the channels 74 and 76 thereby to retain the conductors in their proper positions on the rearward end of the housing.

Figure 6:
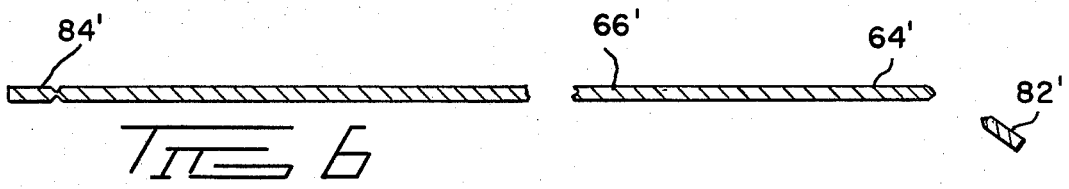
FIGS. 6–9 are a series of views illustrating the assembly of a group of conductors to a jack housing.
Figure 7:
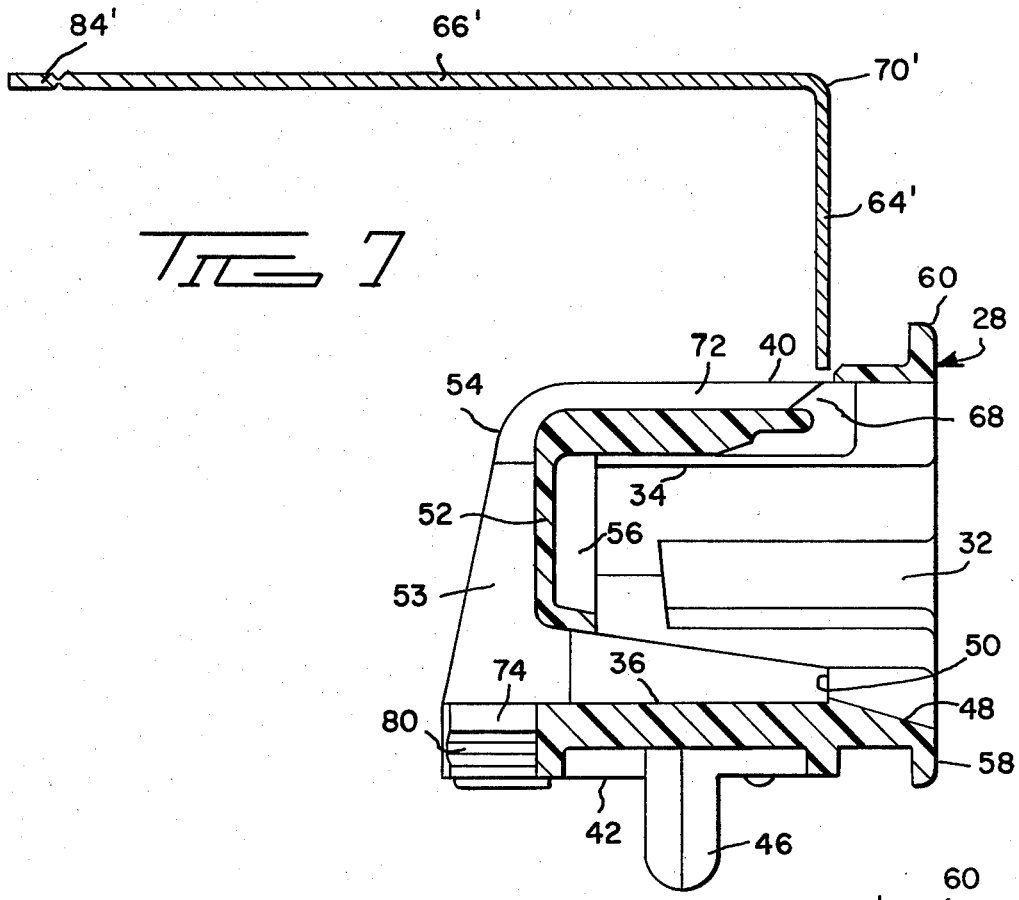

The assembly steps described above can be carried out manually or with the aid of very simple assembly fixtures and tools, if desired, such as a bending fixture to form the bend 70' of FIG. 6, and the carrier strips 82, 84 can be severed with cutters, at the appropriate stages of the assembly operation, from the conductors. Alternatively, and for high volume production, automatic tooling can be used to carry out the operations shown in FIGS. 6–9.

Figure 10:
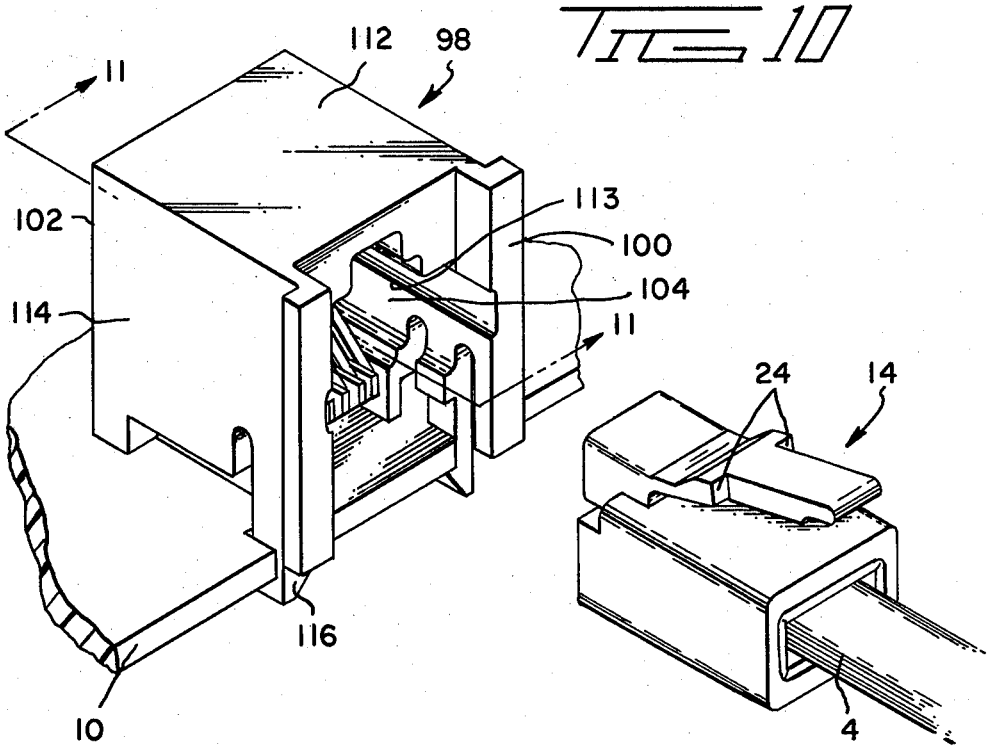
FIG. 10 is a view similar to FIG. 1 of an alternative form of receptacle jack.
Figure 11:
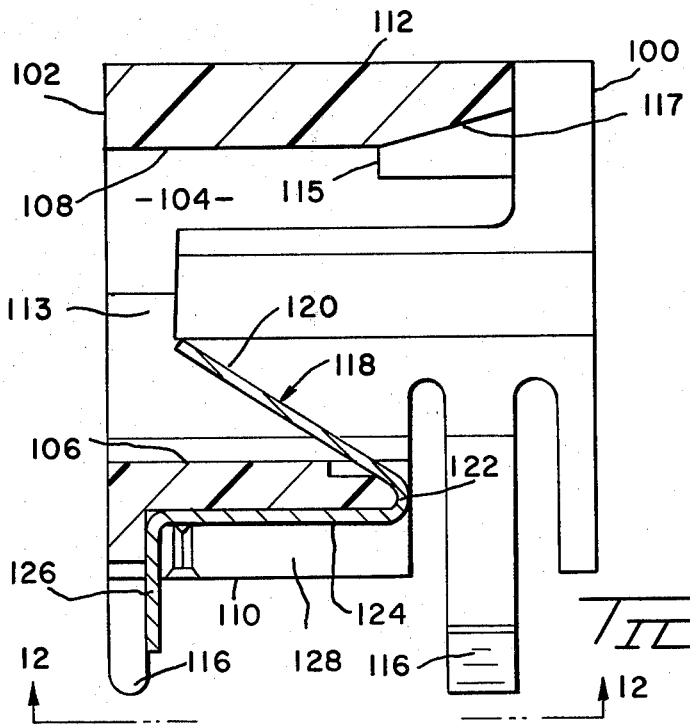
FIG. 11 is a cross-sectional view taken along the lines 11—11 of FIG. 10.
Figure 12:
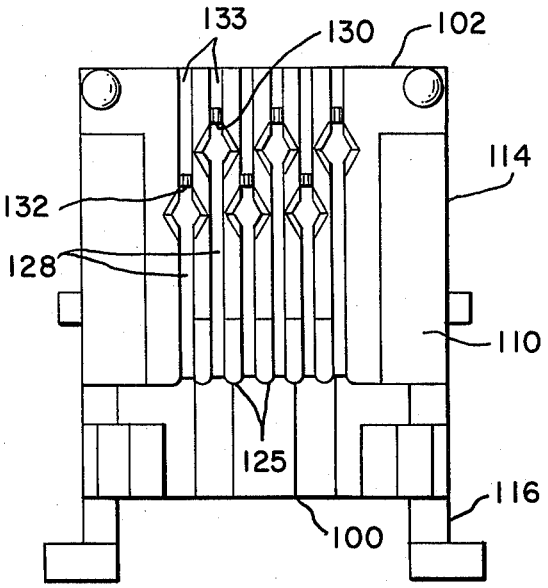
FIG. 12 is a plan view looking in the direction of the arrows 12—12 of FIG. 11 of the downwardly facing side of the receptacle housing.

Referring now to FIGS. 10–12, an alternative type jack receptacle 98, which is more fully disclosed in the above identified U.S. Pat. No. 4,221,458, comprises a one-piece molded housing having a plug-receiving end 100, a rearward end 102, and a plug-receiving opening 104, extending into the plug-receiving end. The opening 104 has opposed first and second internal sidewalls 106, 108, oppositely facing first and second external sidewalls 110, 112, oppositely directed external endwalls 114, and opposed internal endwalls 113. In this embodiment, the first internal sidewall 106, from which the conductors 118 extend, is the lower sidewall as viewed in FIGS. 10 and 11, and the plug 14 is therefore inserted into the opening 104 with the latch arm on the upwardly facing surface of the plug. The internal configuration of the opening 104 is otherwise substantially similar to the opening of the previously described embodiment and thus has a centrally located ramp 117 extending inwardly from the plug-receiving end to the internal sidewall 108 and shoulders 115 on each side of this ramp for cooperation with the shoulders 24 of the latch arm 22 of plug 14.

The conductors generally indicated at 118 have contact portions 120 which extend diagonally into the opening 104 from the internal sidewall 106 at a location adjacent to, but recessed from, the plug-receiving end 100. Each conductor is bent, as shown at 122, at the end of the contact portion 120 and the intermediate, or lead, portion of each conductor 124 extends rearwardly towards the rearward end 102 of the housing. The second end portions 126 are bent laterally so that they extend beyond the external sidewall 110 and may be offset from each other, as described below. The receptacle 98 is mounted on the circuit board 10 by means of alternative mounting means, as shown at 116, which engage openings in the circuit board.

The intermediate portions 124 of the conductors 118 are disposed in side-by-side parallel channels 128 which extend rearwardly in the external sidewall 110 towards, but not to, the rearward end 102 of the housing. Alternate channels 128 have inner ends 130, FIG. 12, which are adjacent to the rearward end of the housing while the remaining channels have inner ends 132 which are spaced from the rearward end by a distance which is greater than the space between the rearward ends 130 of the channels and the rearward end of the housing. The channels have recesses in their sidewalls, as previously described, for cooperation with retaining barbs 140 on the conductors, as explained above with reference to the embodiment of FIG. 1. Shallow grooves 133 which have a depth substantially equal to the thickness of the conductors, extend from the inner ends 130, 132 of the channels to the rearward end of the housing. These grooves 133 serve to position the conductors against the external sidewall 110 when the conductors are assembled to the housing.

As shown best in FIG. 13, a shallow recess 123 is provided in the first internal sidewall 106 adjacent to the mating end of the housing to permit flexure of the individual conductors downwardly, as viewed in FIG. 11, when the plug is inserted into the receptacle. Also, a rounded surface 127 is provided for each conductor extending from each recess 123 to the corresponding conductor-receiving channel 128 and a barrier wall 125 is therefore provided which extends forwardly from the surfaces 127 to separate the conductors, these barrier walls being best shown in FIGS. 12 and 13.

Referring now to FIG. 17, the conductors are manufactured as a continuous strip comprising spaced-apart carrier strips 136, 138 with groups 134 of unformed (i.e., straight) conductors extending between the carrier strips and integral at their ends with the carrier strips. The unformed conductors 118' have barbs 140' as previously described, and alternate conductors are provided with reduced width necks 142 which are spaced from the carrier strip 138, while the remaining conductor blanks are provided with reduced width necks 144 which are immediately adjacent to the carrier strip 138. As will be explained below, the conductor blanks are cut from the carrier strip 138 at these necks so that the conductors are of alternating lengths.

As shown in FIG. 17, the assembly tooling for shearing a group 134 of conductors from the carrier strips 136, 138 and assembling the conductors to a receptacle housing, comprises shearing blocks 146, 148 for severing the conductors from the carrier strip 138, a forming and insertion ram assembly 150 which comprises two ram parts 152, 154, and an additional shearing blade 156 which cooperates with the ram part 154 for shearing the carrier strip 136 from the conductors.

The shearing block 146 has spaced-apart shearing edges 162 which are recessed from the righthand edge of the block and spaced-apart shearing edges 158 which are located at the righthand edge, or side of the block. The shearing block 148, in turn, has shearing edges 164 which cooperate with the shearing edges 162 and shearing edges 160 which cooperate with the shearing edges 158 of the block 146.

The insertion ram part 152 of ram assembly 150 has parallel spaced-apart support ribs on its upper surface 166, 168, the ribs 166 being relatively shorter than the ribs 168, the difference in the lengths of the two sets of ribs being equal to the difference in the lengths of the channels 128 on the underside of the housing. The ribs 166, 168 extend rightwardly, as viewed in FIG. 17, to the second ram part 154 of the ram assembly and this part 154 has spaced-apart recesses 170 on its lefthand side, as viewed in FIG. 17, which provide clearance for the barrier walls 124 of the housing. The shearing blade 156 has a single shearing edge 172 which cooperates with a shearing edge 174 on the block 154.

The ram assembly 150 can be moved relatively upwardly as a unit, see FIGS. 13 and 14, and the ram part 154 can be moved upwardly independently of ram part 152, as shown in FIG. 15. The tooling can be mounted in a suitable assembly machine capable of effecting the movements of the ram and the movements of the shearing members 146, 148 and 156.

To assemble a group 138 of conductors to a housing, the strip is fed rightwardly in FIG. 17, to locate a group of conductors between a connector housing and the upper surface portions of the ram assembly 150 with the conductors extending between the two shearing members 146, 148. The conductors will thus be positioned on the upper surfaces of the ram assembly, as shown in FIG. 13, with the ends extending over the upper surface of the shearing block 146 and the housing can then be positioned, as shown in FIG. 13, with the conductors in alignment with the channels 128 and with the conductors received in the shallow positioning grooves 133. After such positioning on the conductors in the housing, shearing block 148 is moved relatively downwardly from the position of FIG. 13 to shear the conductors from the carrier strip 138 at the reduced width neck portions 142, 144. Thereafter, the insertion and forming ram assembly 150 is moved upwardly relative to the receptacle housing to the position of FIG. 14, causing movement of the intermediate, or lead, portions of the conductors into the channels 128 with accompanying downward bending of the end portions 126 of the conductors. The conductors will thus be offset from each other by virtue of the alternating lengths of the conductor-receiving channels 138. The shearing blade 156 is then moved downwardly from the position of FIG. 14 to sever the conductors from the carrier strip 136 and ram member 154 is then moved upwardly to bend the contact portions 120 of the conductors upwardly, as shown in FIG. 15. Thereafter, it is only necessary to remove the receptacle from the assembly tooling and insert a plug 14 into the plug-receiving opening to bend the conductors inwardly to their final position, as shown in FIG. 11.

The conductors can be assembled to the housing 98 by more simplified tooling, if desired, and as explained above, they can be assembled with simple fixtures and hand tools if desired. The tooling illustrated in FIG. 17 is representative of the general type of tooling which can be provided, but it should be realized that the precise form of assembly tooling will be dictated, to a large extent, by the precise form of the connector receptacle.

The principles of the invention can be practiced with a wide variety of precise or specific receptacle embodiments, such as the types shown in application Ser. No. 967,441 (U.S. Pat. No. 4,193,654), and in application Ser. No. 040,242 U.S. Pat. No. 4,225,209.

We claim:

1. A method of manufacturing an electrical connector receptacle of the type comprising an insulating housing having a plug-receiving end and a rearward end, a plug-receiving opening extending into said plug-receiving end, said opening having opposed internal sidewalls and opposed internal endwalls, said housing having oppositely facing external sidewalls which are substantially parallel to said internal sidewalls, a plurality of electrical conductors in side-by-side spaced-apart relationship, each of said conductors comprising a contact spring extending from one of said internal sidewalls at a location adjacent to said plug-receiving end diagonally into said opening and towards the opposite internal sidewall, and each conductor having a lead portion extending from said plug-receiving end towards said rearward end, said method comprising the steps of:

producing said housing as a one-piece molded part having a plurality of side-by-side channels extending from said plug-receiving end towards said rearward end in the one of said external sidewalls which is adjacent to said one internal sidewall, manufacturing said conductors as a continuous flat sheet metal strip comprising a carrier strip means having at spaced intervals groups of said conductors extending in side-by-side coplanar relationship from one side edge of said carrier strip means with each group containing the number of conductors required for one of said receptacles, positioning said housing adjacent to one of said groups of conductors with intermediate portions of said conductors in alignment with said channels, and moving said one group of conductors normally of their axes towards said housing and inserting said intermediate portions into said channels, and bending first end portions of said conductors into said plug-receiving opening whereby said first end portions function as said contact springs and said intermediate portions of said conductors function as said lead portions.

2. A method as set forth in claim 1, including the step of bending said second end portions of said conductors normally of said intermediate portions and towards said rearward end whereby said second end portions extend across said rearward end of said housing.

3. A method of manufacturing an electrical connector receptacle of the type comprising an insulating housing having a plug-receiving end and a rearward end, a plug-receiving opening extending into said plug-receiving end, said opening having opposed internal sidewalls and opposed internal endwalls, said housing having oppositely facing external sidewalls which are substantially parallel to said internal sidewalls, a plurality of electrical conductors in side-by-side spaced-apart relationship, each of said conductors comprising a contact spring extending from one of said internal sidewalls at a location adjacent to said plug-receiving end diagonally into said opening and towards the opposite internal sidewall, and each conductor having a lead portion extending from said plug-receiving end towards said rearward end, said method comprising the steps of:

producing said housing as a one-piece part having a plurality of side-by-side channels extending from said plug-receiving end towards said rearward end in the one of said external sidewalls which is adjacent to said one internal sidewall, manufacturing said conductors by stamping a continuous flat sheet metal strip and producing a conductor strip having spaced-apart first and second carrier strips and having groups of said conductors extending between said carrier strips with the number of conductors in each group equal to the number of conductors required for one of said connector receptacles and with first and second ends of each conductor integral with said first and second carrier strips respectively, and with said carrier strips and said conductors coplanar, positioning one of said groups of conductors adjacent to said one external sidewall with intermediate portions of said conductors in alignment with said channels and with said first end portions of said conductors proximate to said plug-receiving end, severing said carrier strips from said conductors, moving said one group of conductors normally of their axes towards said one external sidewall and inserting said intermediate portions into said channels, and bending first end portions of said conductors into said plug-receiving opening whereby said first end portions function as said contact springs and said intermediate portions of said conductors function as said lead portions.

4. A method as set forth in claim 3 in which said first carrier strip is severed from said first ends of said conductors prior to insertion of said intermediate portions into said channels.

5. A method as set forth in claim 3 in which said second carrier strip is severed from said second ends of said conductors prior to insertion of said intermediate portions into said channels.

6. A method as set forth in claim 3, including the step of providing retaining means on said conductors which are engageable with sidewall portions of said channels whereby said conductors are retained in said channels by said retaining means.

7. A method as set forth in either of claims 4 or 5, including the step of bending said second end portions of said conductors laterally of said intermediate portions and towards said rearward end of said housing whereby said second end portions extend laterally of said one external sidewall and across said rearward end.

8. A method as set forth in claim 3, including the step of offsetting the second end portions of every other one of said conductors relative to the remaining conductors whereby said second end portions are staggered.

9. A method as set forth in claim 4, including the step of bending said first end portions of said conductors prior to insertion of said intermediate portions into said channels whereby said first end portions extend across said plug-receiving opening after insertion of said intermediate portions into said channels.

10. A method as set forth in claim 4, including the step of providing additional side-by-side channels in said rearward end of said housing with alternate channels being relatively deeper than the remaining channels, and bending said second ends of said conductors towards said rearward end of said housing and positioning said conductors in said additional channels whereby said second end portions of said conductors will extend beyond the other one of said external sidewalls and alternate conductors will be offset from the remaining conductors.

11. A method as set forth in claim 4, including the step of selectively electroplating a narrow band of conductive corrosion resistant metal on said conductor strip adjacent to said first ends of said conductors whereby said contact portions of said conductors in said connector receptacle are selectively plated with said conductive corrosion resistant metal.

* * * * *